US007367072B1

(12) United States Patent
Lubin

(10) Patent No.: US 7,367,072 B1
(45) Date of Patent: May 6, 2008

(54) METHOD AND APPARATUS FOR ELEVATING A PILLOW

(76) Inventor: David Lubin, 121 Key Haven Ct., Tampa, FL (US) 33606

( * ) Notice: Subject to any disclaimer, the term of this patent is extended or adjusted under 35 U.S.C. 154(b) by 0 days.

(21) Appl. No.: 11/396,785

(22) Filed: Apr. 1, 2006

Related U.S. Application Data

(60) Provisional application No. 60/667,420, filed on Apr. 1, 2005.

(51) Int. Cl.
*A47G 9/10* (2006.01)

(52) U.S. Cl. ..... 5/636; 5/630; 5/632; 5/640

(58) Field of Classification Search ..... 5/691, 5/630, 632, 652, 653, 657, 490, 645, 656, 5/659, 646, 637, 638, 640, 643, 647
See application file for complete search history.

(56) References Cited

U.S. PATENT DOCUMENTS 5,579,551 A * 12/1996 Tommaney ..... 5/636
5,604,944 A * 2/1997 Meade ..... 5/643
6,151,736 A * 11/2000 Samuels ..... 5/653
6,581,226 B1 * 6/2003 Brustein ..... 5/643
2005/0138733 A1 * 6/2005 Riesberg et al. ..... 5/640
2005/0177944 A1 * 8/2005 Kang et al. ..... 5/636
2006/0282952 A1 * 12/2006 Laxton ..... 5/636

* cited by examiner

*Primary Examiner*—Michael Trettel
(74) *Attorney, Agent, or Firm*—Kenneth L Tolar

(57) ABSTRACT

A device for elevating a sleeper's pillow to allow an arm to be comfortably placed between the pillow and mattress includes an elliptical padded disc having a predetermined thickness. The disc is preferably encapsulated with a removable cover allowing both the disc and cover to be cleaned. Accordingly, when the device is placed beneath a sleeper's pillow, the pillow is elevated allowing a sleeper to comfortably place an arm between the pillow and mattress.

2 Claims, 2 Drawing Sheets

METHOD AND APPARATUS FOR ELEVATING A PILLOW

CROSS REFERENCE TO RELATED APPLICATIONS

This application is entitled to the benefit of provisional application No. 60/667,420 filed on Apr. 1, 2005, the specification of which is incorporated herein by reference.

BACKGROUND OF THE INVENTION

The present invention relates to a device that allows a sleeper to comfortably position an arm beneath a pillow.

DESCRIPTION OF THE PRIOR ART

Sleepers typically place their arms in various positions while sleeping. Many prefer to slide their arms beneath the pillow on which the sleeper's head is resting. The weight of the sleeper's head places significant pressure on the arm thereby increasing pressure on the nerves that extend from the neck, through the shoulders and ultimately to the arm and hand. The intense pressure can inhibit sound sleep, and can lead to soreness in the neck and arm as well as numbness in the involved extremity.

Furthermore, those who sleep on their sides often experience chronic neck and shoulder pain due to spinal misalignment. Stacking multiple pillows elevates the head but does not allow the sleeper to comfortably position an arm beneath the stack without incurring the intense pressure described above. Accordingly, there is currently a need for a device that allows a sleeper to elevate a pillow so that an arm can be placed therebelow. The present invention addresses this need by providing a padded disc that is placed beneath a sleeper's pillow to elevate the pillow a predetermined distance from the mattress. Accordingly, a space for the arm is created and any pressure applied to the pillow is absorbed by the disc.

SUMMARY OF THE INVENTION

The present invention relates to a method and apparatus for elevating a pillow. The device comprises a substantially elliptical disc having a predetermined thickness that is formed with a soft, padded material such as foam. The disc is encapsulated with a removable outer casing that protects the disc and which can removed for cleaning.

To use the above described device, a user places the encapsulated disc beneath a pillow thereby elevating a portion of the pillow a predetermined distance above the mattress to create a void space therebetween. Accordingly, a load resting on the pillow will be substantially absorbed by the disc whereby a sleeper who places an arm beneath the pillow will have minimal pressure applied thereto.

It is therefore an object of the present invention to provide a device that enhances sleep and which minimizes discomfort in the neck, shoulder, arm, and hand.

It is another object of the present invention to provide a device that allows a sleeper to comfortably place an arm beneath a pillow.

It is yet another object of the present invention to provide a support for a vehicle driver's lower back thereby minimizing the potential for lower back pain while driving.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
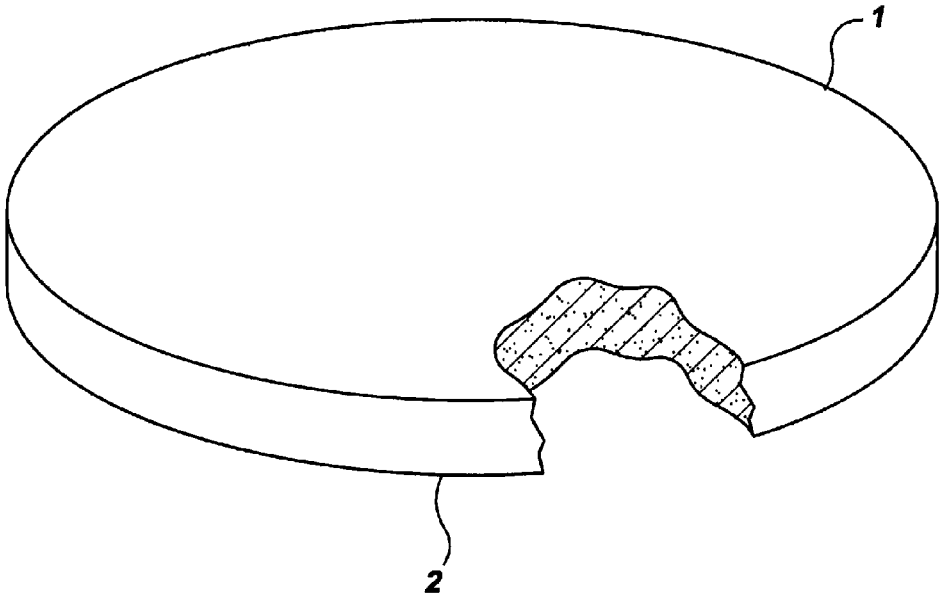
FIG. 1 is a perspective, partial cutaway view of the device.
Figure 2:
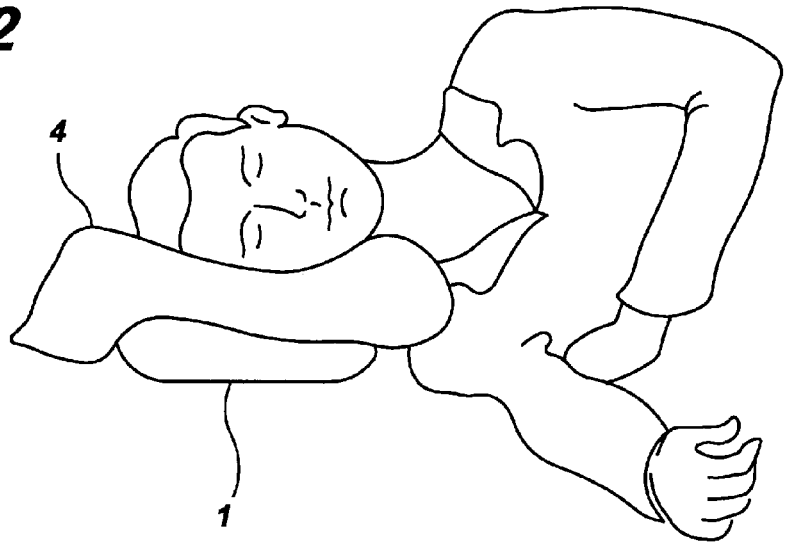
FIG. 2 depicts the device appropriately positioned beneath a pillow with a sleeper's head resting thereon.
Figure 3:
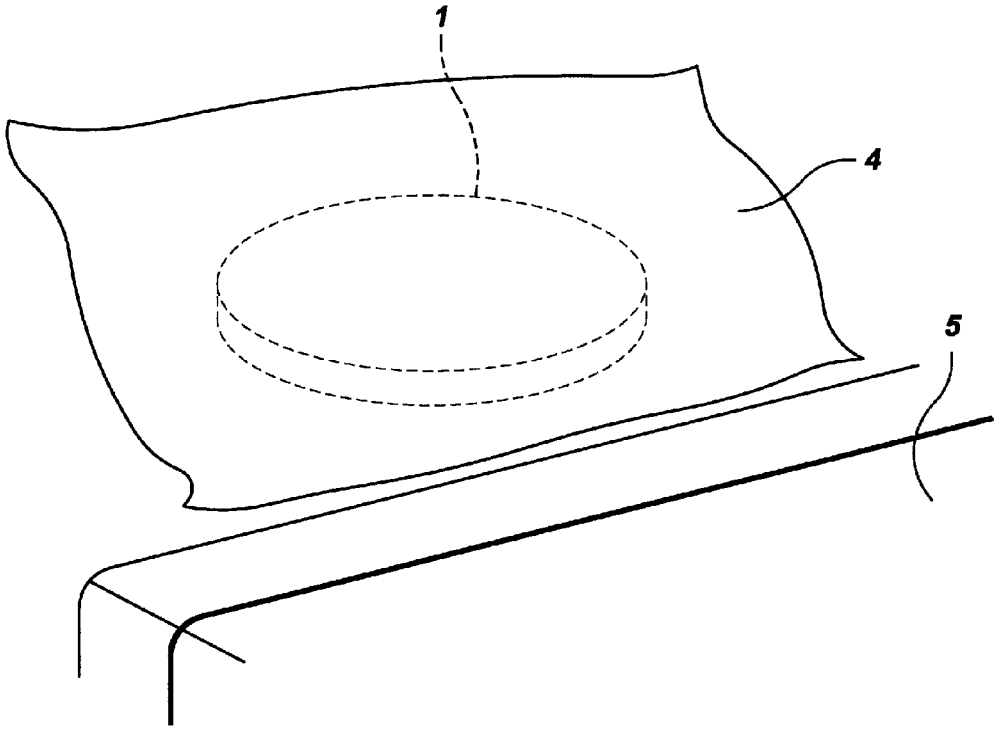
FIG. 3 depicts the device in phantom positioned beneath a pillow.

The present invention relates to a method and apparatus for elevating a pillow. The device comprises a substantially elliptical disc 1 having a predetermined thickness that is formed with a soft, padded material such as comfort foam. The disc is encapsulated with a removable outer casing 2 that can be removed allowing the disc to be cleaned, if necessary or desired.

To use the above described device, a user places the encapsulated disc beneath a pillow 4 thereby elevating a portion of the pillow a predetermined distance above the mattress 5 to create a void space therebetween. Accordingly, a load resting on the pillow will be substantially absorbed by the disc whereby a sleeper who places an arm beneath the pillow will have minimal pressure applied thereto.

In the preferred embodiment, the disc is approximately fourteen inches wide, nine inches long and at least two inches thick. However, the above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A method for elevating a pillow so as to reduce pressure on an arm placed beneath the pillow comprising the steps of:

forming a disc from a soft, padded material, said disc being unattached to said pillow;

placing the disc beneath the pillow to elevate the pillow thereby creating a void space between the pillow and an underlying mattress allowing a sleeper's arm to be placed beneath the pillow without applying excessive stress thereto.

2. The method according to claim 1 further comprising the steps of:

encapsulating the disc with a removable outer casing that protects the disc while allowing the disc to be removed for cleaning.

* * * * *